US007715735B2

(12) United States Patent
Nishikata et al.

(10) Patent No.: US 7,715,735 B2
(45) Date of Patent: May 11, 2010

(54) IMAGE FORMING SYSTEM AND CONTROL METHOD FOR THE SAME

(75) Inventors: Akinobu Nishikata, Kashiwa (JP); Ichiro Sasaki, Toride (JP); Mitsuhiko Sato, Kashiwa (JP); Hidenori Sunada, Toride (JP); Manabu Yamauchi, Kashiwa (JP); Naoto Watanabe, Abiko (JP); Takayuki Fujii, Tokyo (JP); Shunsuke Nishimura, Toride (JP)

(73) Assignee: Canon Kabushiki Kaisha (JP)

( * ) Notice: Subject to any disclaimer, the term of this patent is extended or adjusted under 35 U.S.C. 154(b) by 427 days.

(21) Appl. No.: 11/469,730

(22) Filed: Sep. 1, 2006

(65) Prior Publication Data

US 2007/0053700 A1 Mar. 8, 2007

(30) Foreign Application Priority Data

Sep. 6, 2005 (JP) ..... 2005-258309

(51) Int. Cl.
*G03G 15/00* (2006.01)

(52) U.S. Cl. ..... 399/21; 271/9.02; 271/225; 271/256; 271/258.01; 271/258.02; 271/258.04; 271/279

(58) Field of Classification Search ..... 399/20, 399/21; 271/9.02, 225, 256, 258.01, 258.02, 271/258.04, 279
See application file for complete search history.

(56) References Cited

U.S. PATENT DOCUMENTS

| | | | |
|---|---|---|---|
| 6,483,601 | B1 | 11/2002 | Yoneyama et al. |
| 2004/0153530 | A1 | 8/2004 | Machida |
| 2004/0190057 | A1 | 9/2004 | Takahashi et al. |
| 2004/0240835 | A1 | 12/2004 | Kuroda |
| 2005/0068547 | A1 | 3/2005 | Negishi et al. |
| 2005/0088681 | A1 * | 4/2005 | Hosoda ..... 358/1.14 |
| 2005/0105129 | A1 | 5/2005 | Takahashi |
| 2007/0086045 | A1 | 4/2007 | Nishikata et al. |

FOREIGN PATENT DOCUMENTS

| | | | |
|---|---|---|---|
| EP | 1 531 610 | A2 | 5/2005 |
| JP | 6-219597 | A | 8/1994 |
| JP | 08-208104 | A | 8/1996 |
| JP | 11-232243 | A | 8/1999 |
| JP | 11-352848 | A | 12/1999 |

(Continued)

OTHER PUBLICATIONS

English translation of JP 11-352848.

(Continued)

*Primary Examiner*—Judy Nguyen
*Assistant Examiner*—Andy L Pham
(74) *Attorney, Agent, or Firm*—Rossi, Kimms & McDowell LLP

(57) ABSTRACT

An image forming system that has an apparatus that receives recording media from an apparatus upstream from it, executes image formation processing, and conveys the recording media to an apparatus positioned downstream from it. The apparatus controls whether to continue conveyance of recording media, change their discharger, and accept recording media in accordance with condition of its own or the downstream apparatus regardless of the configuration of the entire system.

5 Claims, 12 Drawing Sheets

FOREIGN PATENT DOCUMENTS

| | | | |
|---|---|---|---|
| JP | 2001-096841 | A | 4/2001 |
| JP | 2002-139966 | A | 5/2002 |
| JP | 2005-195858 | A | 7/2005 |
| JP | 2005-206264 | A | 8/2005 |

OTHER PUBLICATIONS

English translation of JP 8-208104.
English translation of JP 2005-206264.
Notice of Allowance issued in Korean application No. 9-5-2007-057288957, mailed on Oct. 26, 2007. The Korean application corresponds to related co-pending U.S. publication 2007-0086045A1.
Search Report issued in EP 06 01 7321.8-2209, mailed on Jun. 1, 2007. The EP application corresponds to related co-pending U.S. publication 2007-0086045A1.
Office Action issued in corresponding Japanese Patent Application No. 2005-258309 dated Dec. 4, 2009.
English translation of JP 11-352848 published on Dec. 24, 1999.
English translation of JP 8-208104 published on Aug. 13, 1996.
English translation of JP 2005-206264 published on Aug. 4, 2005.

* cited by examiner

FIG. 12

| JOB NAME | SHEET | RESULT OF DISCHARGE |
|---|---|---|
| A | 1 | DISCHARGED SUCCESSFULLY |
| | 2 | DISCHARGED SUCCESSFULLY |
| | 3 | DISCHARGED AS INVALID SHEET |
| | 4 | DISCHARGED AS INVALID SHEET |

IMAGE FORMING SYSTEM AND CONTROL METHOD FOR THE SAME

BACKGROUND OF THE INVENTION

1. Field of the Invention

The present invention relates to an image forming technique, and more particularly, to an image forming system that includes an information forming apparatus for forming images on recording media, a sheet feeder for supplying recording media to the image forming apparatus, and post-processing apparatuses for performing post-processing to recording media on which images are formed.

2. Description of the Related Art

In recent years, with enhanced speed and image quality of image forming apparatuses that use in electrophotographic method and/or ink-jet printing apparatuses, a system called Print On Demand (POD) that can handle a large number of copies or jobs has emerged.

In POD, a printing operation and its post-processing are conducted in accordance with individual operators' needs in an office environment in which an image forming apparatus is connected to apparatuses capable of bookbinding or cutting as well as a sheet feeder for feeding various types of recording sheets to the image forming apparatus.

In a conventional image forming system for application to POD that is made up of a number of apparatuses such as image forming apparatuses, sheet feeders and post-processing apparatuses, order of connection or arrangement among the apparatuses are defined by dedicated lines connecting the apparatuses. By communicating over the dedicated lines, the apparatuses exchange data relating to printing jobs and process a series of printing jobs including sheet feeding, image formation and post-processing.

When a failure such as paper jam occurs while recording sheets are conveyed among the apparatuses, the only action one can take is to stop the entire image forming system, and in such a case, a large number of recording sheets can remain in the image forming system. To solve this problem, apparatuses have been invented that have a discharge tray to which recording sheets being conveyed are urgently discharged (hereinafter referred to as an "escape tray").

Also, connection of apparatuses, such as an image forming apparatus and post-processing apparatuses, with dedicated lines fixes the configuration of the image forming system or arrangement of the apparatuses. It thus is difficult to change order of arrangement of apparatuses making up an image forming system or to add a new apparatus in accordance with users' usage (e.g., printing format and post-processing utilized). Consequently, image forming systems that allow flexible change of arrangement have been also proposed.

An example of such prior art is one disclosed in Japanese Patent Laid-Open No. H11-232243.

In a conventional image forming system, however, urgent discharge of recording sheets cannot be carried out unless all apparatuses recognize where in the image forming system an escape tray is positioned.

Especially when one is allowed to flexibly change the order of arrangement among apparatuses, the position of an escape tray will be also changed along with repositioning of apparatuses constituting the image forming system. Conventional image forming systems have the problem of needing to locate an escape tray for all possible combinations corresponding to repositioning of apparatuses, which can complicate control of these image forming systems.

SUMMARY OF THE INVENTION

In view of the problem outlined above, an object of the present invention is to provide an image forming technique that allows one to control the continuation of recording sheet conveyance, change of their discharger, and acceptance of recording sheets in accordance with the condition of the image forming apparatus or its downstream apparatus without having to be conscious of the arrangement of the apparatuses of the entire image forming system.

To attain the object, the image forming system according to the invention is characterized by having arrangements as follows.

According to the present invention, the foregoing object is attained by providing an image forming system that is configured by an image forming apparatus and sheet processing apparatuses attached thereto, the image forming apparatus and the sheet processing apparatuses being capable of connecting to a network, the image forming system comprising:

a storage unit adapted to store identification information for identifying the sheet processing apparatuses connected to the network and information on order of arrangement of the sheet processing apparatuses; and a determination unit adapted to determine the system configuration for performing image formation based on the information stored in the storage unit and information on results of communication with the sheet processing apparatuses.

According to another aspect of the present invention, the foregoing object is attained by providing a control method for an image forming system that has apparatuses for receiving recording media from an upstream sheet processing apparatus that is positioned upstream from them, executing sheet processing, and conveying recording media to which sheet processing has been applied to a downstream sheet processing that is positioned downstream from them, the method comprising:

a detection step of detecting an abnormal condition occurring on an apparatus that configures the image forming system;

a reception step of receiving acceptance advisability information sent from the downstream sheet processing apparatus for determining whether the recording media can be accepted or not;

a determination step of determining whether the recording media can be accepted or not based on a detection result of an abnormal condition detected at the detection step or the acceptance advisability information received at the reception step; and a notification step of notifying determination result at the determination step to the upstream sheet processing apparatus as acceptance advisability information on the apparatus.

According to the invention, it is possible to control continuation of recording sheet conveyance, change of sheets discharger, and acceptance of recording sheets in accordance with condition of an apparatus in question or its downstream apparatus without having to be conscious of the arrangement of apparatuses of the entire image forming system.

Further features of the present invention will become apparent from the following description of exemplary embodiments with reference to the attached drawings.

BRIEF DESCRIPTION OF THE DRAWINGS

FIG. 12 shows an exemplary table for managing results of sheet discharge.

DESCRIPTION OF THE EMBODIMENTS

First Embodiment (Connection Form of the Image Forming System)

A first embodiment of the invention will be described below with reference to drawings.

The image forming system of the embodiment is an image forming system that has apparatuses which receive recording media from an upstream apparatus positioned upstream from them, execute predetermined processing, and convey processed recording media to a downstream apparatus that is positioned downstream from them. Such an apparatuses constituting the system have a configuration as follows.

The apparatus includes a detection unit for detecting an abnormal condition occurring in a apparatus (e.g., conveying path sensors 304 and 305), and a reception unit (e.g., a communication I/F 207) for receiving acceptance advisability information sent from a downstream apparatus for use in determining whether the downstream apparatus can accept recording media. The apparatus also includes a determination unit for determining whether or not the apparatus can accept recording media based on a detected abnormal condition or received acceptance advisability information, and a notification unit for notifying the result of determination as acceptance advisability information on the apparatus to an upstream apparatus. The functions of the determination and notification units can be realized with data stored in RAM 205, a control program stored in ROM 206, and the communication I/F 207, under control of a CPU 201.

Figure 1:
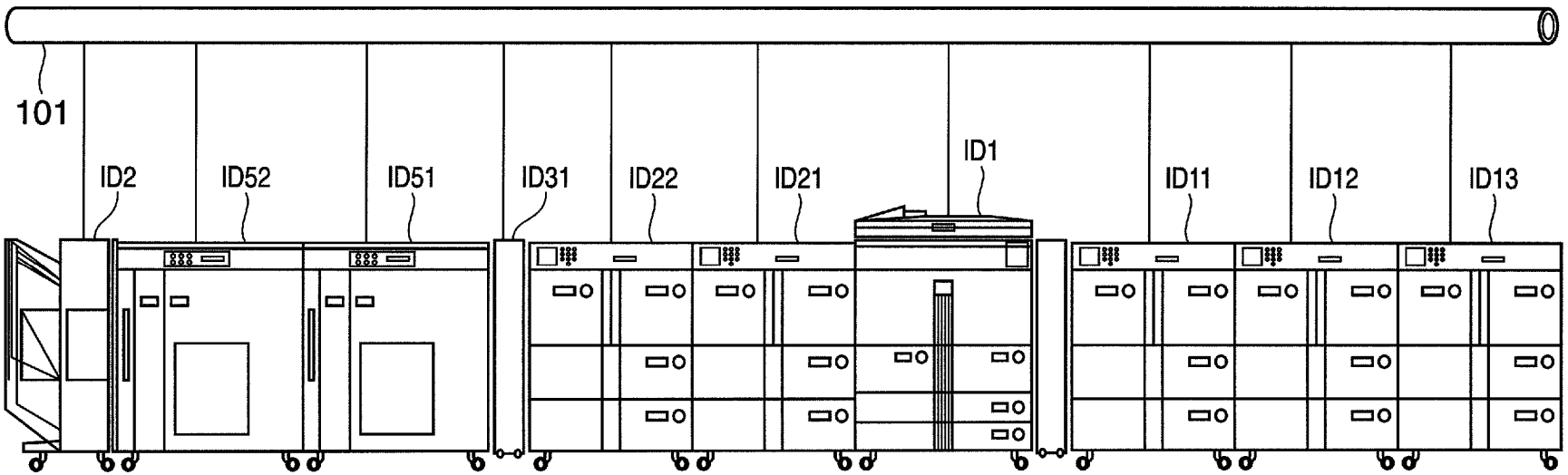
FIG. 1 shows connection form in an image forming system according to an embodiment of the invention.

FIG. 1 shows connection form of the image forming system according to the embodiment of the invention. In FIG. 1, the image forming system is built around an image forming apparatus (hereinafter also called an "engine") (ID1) that forms images on recording media including recording sheets (hereinafter "sheets"). Positioned upstream of the engine (ID) (i.e., right in FIG. 1) are sheet feeding decks (ID11, ID 12, ID13) that are sheet processing apparatuses (sheet feeders) for supplying sheets to the engine (ID1). Positioned downstream of the engine (ID1) (left in FIG. 1) are inserters (ID21 and ID22), which are sheet processing apparatuses for feeding insert paper such as cover sheets and inserting paper among sheets on which images are formed by the engine (ID1).

Further downstream of the inserter (ID22) (left in FIG. 1), a puncher (ID31) is positioned as a sheet processing apparatus for punching holes on sheets conveyed from the engine (ID9) and the inserters (ID21 and ID22). Stackers (ID51 and ID52) for stacking sheets, and a finisher (ID2) for providing sheet processing (post-processing) such as stapling and sorting are also positioned. The engine, sheet feeding decks, inserters, puncher, stackers, and finisher are each interconnected by a network 101, which may be a LAN cable, for example.

Each of the apparatuses constituting the image forming system has a network ID set for it that is an identifier (ID) identifiable on the network 101. The apparatuses can communicate with each other by a communication scheme such as Arcnet (a registered trademark). Commands relating to image forming operation can be communicated between an apparatus (e.g., the inserter (ID22)), an apparatus upstream of it (i.e., the inserter (ID21)), an apparatus downstream of it (i.e., the puncher (ID31)), and the engine (ID1). Information on node ID search or status can be accepted regardless of the node ID of the sender (e.g., the engine (ID1)).

The communication scheme used in the present invention is not limited to Arcnet (a registered trademark); communication can be made by other communication protocols that utilize telecommunication line.

(Configuration of the Control Unit)

Figure 2:
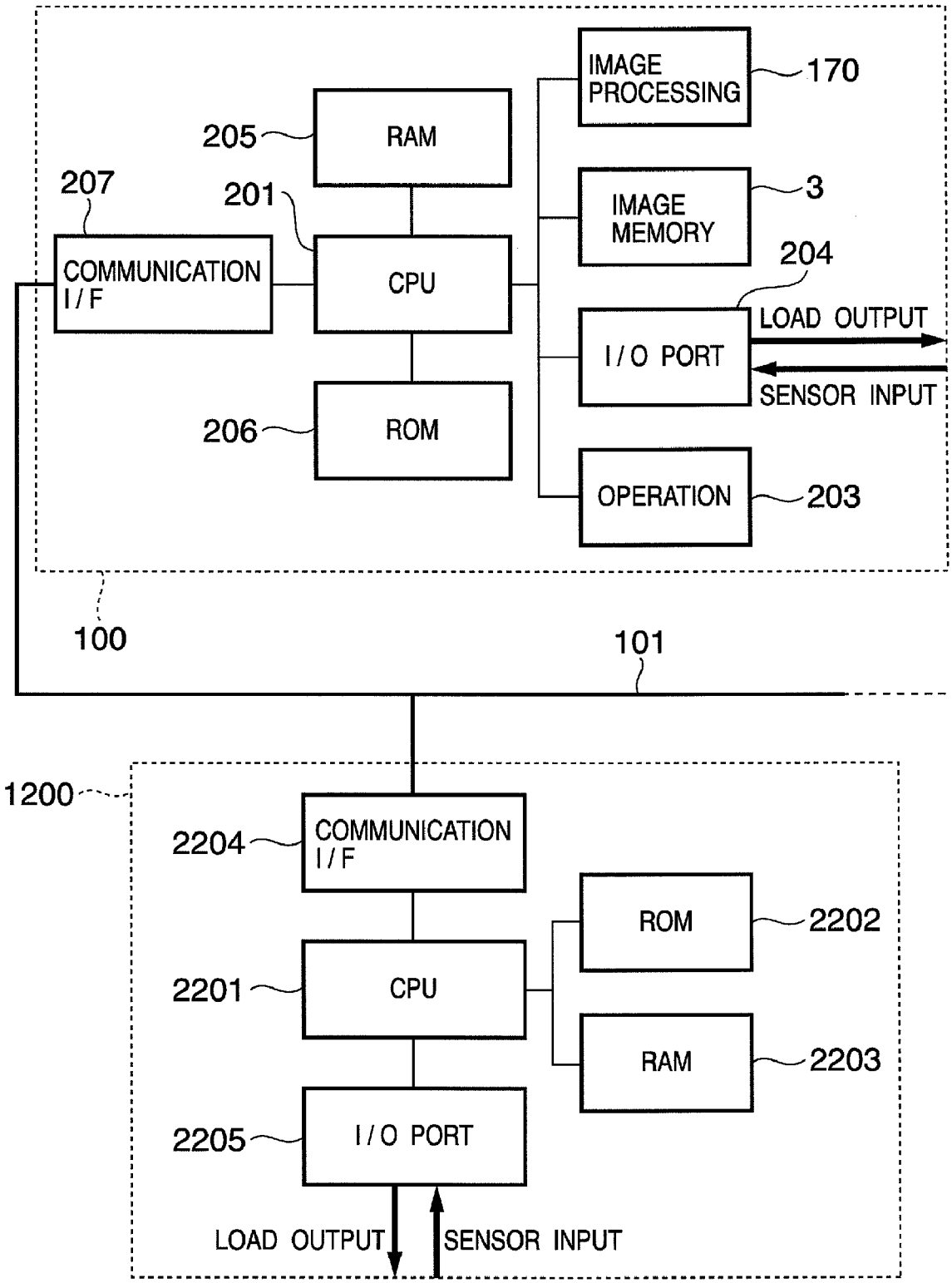
FIG. 2 is a block diagram showing the configuration of a control unit in an image forming apparatus, and that of control units in other apparatuses such as sheet feeders or finishers that are connected to a network.

FIG. 2 is a block diagram showing the configuration of the control unit of the image forming apparatus 100, and that of the control unit in other apparatuses 1200 (hereinafter "apparatuses on the network") that are connected by the network 101, such as sheet feeders and finisher.

In FIG. 2, reference numeral 201 denotes a CPU for providing basic control of the image forming apparatus 100, and 206 denotes ROM in which a control program is written. Reference numeral 205 denotes RAM that serves as a work area for executing processing of the control program. A portion of the RAM 205 is back-up RAM in which data is not erased when the image forming apparatus 100 is powered off.

An I/O port 204 is connected to an address bus and a data bus. The I/O port 204 is capable of outputting control signals for various loading devices such as motors and clutches controlled by the CPU 201 of the image forming apparatus 100 and inputting sensor signals from sensors that detect sheet position. The CPU 201 can control various loading devices such as motors and clutches via the I/O port 204 in accordance with contents of the control program stored in the ROM 206, being responsible for execution of image forming operation.

The CPU 201 is connected to an operation unit 203 and controls display and/or key entry on the operation unit 203. A user can indicate operation mode of the image forming apparatus 100 and/or switching of display on the operation unit 203 to the CPU 201 through key entry on the operation unit 203. The CPU 201 can also control the display area of the operation unit 203 to display the operation state of the image forming apparatus 100 or an operation mode that is set through key entry.

An image processing unit 170 for processing image signals that have been converted to electric signals and an image memory unit 3 for storing processed images are also connected to the CPU 201.

Reference numeral 207 denotes a communication interface (IF) for the CPU 201 to communicate with the apparatuses 1200 on the network. The CPU 201 can communicate with the CPU 2201 of the apparatuses 1200 on the network via the communication I/F 207 of the image forming apparatus 100 and a communication I/F 2004 of the apparatuses 1200 on the network. When the CPU 201 sends a signal requesting for the node ID of an apparatus to the apparatus 1200 on the network, the apparatus 1200 on the network transmits its node ID that is stored in the ROM 2202 of the apparatus 1200 in response (ID2 for the finisher, for example). Thus, the CPU 201 can obtain a node ID for any of the apparatuses 1200 on the network.

Reference numeral 2201 denotes a CPU that provides basic control of the apparatuses 1200 on the network, and 2202 denotes ROM in which a control program and the node ID of an apparatus are written. Reference numeral 2203 denotes RAM that serves as a work area for executing processing of the control program.

The I/O port 2205 is connected to an address bus and a data bus. The I/O port 2205 is capable of outputting control signals for various loading devices such as motors and clutches controlled by the apparatuses 1200 on the network, and inputting sensor signals from sensors that detect sheet position, for example.

The CPU 2201 is capable of controlling various loading devices such as motors and clutches via the I/O port 2205. The CPU 2201 can provide control corresponding to a command from the image forming apparatus 100 (e.g., control for punching for the puncher (ID31), or for execution of predetermined post-processing for the finisher (ID2)).

(Description of Paper Jam)

Figure 3:
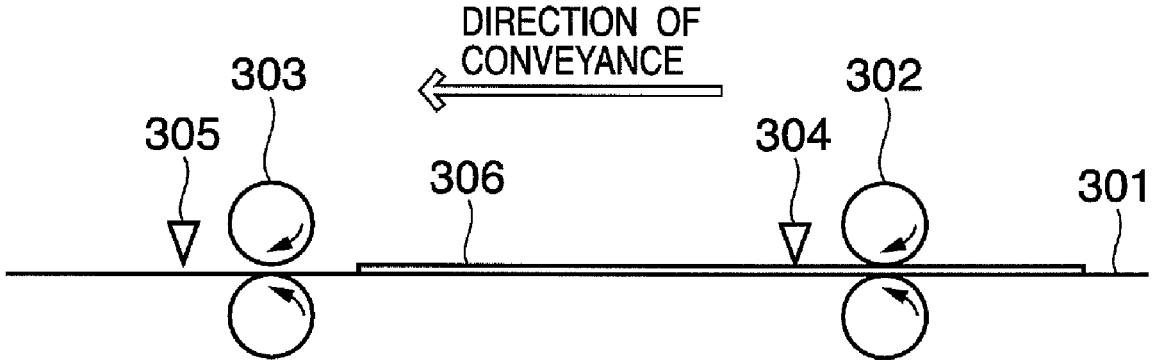
FIG. 3 illustrates detection of paper jam condition during sheet conveyance.

FIG. 3 illustrates detection of a paper jam condition during sheet conveyance. A sheet 306 is conveyed along a conveying path 301. On the conveying path 301, conveying rollers 302 and 303 are positioned and they are controlled to rotate in the direction indicated with an arrow in the figure. Downstream from the conveying roller 302 (i.e., left of 302) and downstream from the conveying roller 303 (i.e., left of 303), conveying path sensors 304 and 305 are positioned, which detect passing of the sheet 306.

The sheet 306 is conveyed on the conveying path 301 through conveying rollers 302 and 303 from upstream (i.e., from right in FIG. 3). It time between the sheet passing the conveying path sensor 304 and passing the conveying path sensor 305 exceeds a certain time, the CPUs of apparatuses will determine that the sheet was not successfully conveyed and detect a paper jam.

(Description on Notification of Sheet Acceptance Advisability)

FIGS. 4A to 4D illustrate notification of sheet acceptance advisability in the image forming system according to the embodiment. The apparatuses constituting the image forming system are capable of detecting an abnormal condition in image formation, e.g., occurrence of a paper jam on a conveying path. They are also capable of identifying functions provided by each apparatus, such as attachment of an escape tray for urgently discharging sheets or a stacker tray that is attached for ejecting sheets. Under control of the CPUs (201 and 2201), each of the apparatuses detects any abnormal condition and identifies functions of an apparatus, determines whether it can accept sheets, and notifies the result of the determination to an apparatus that is positioned upstream of the apparatus (i.e., right on the figure).

In FIGS. 4A to 4D, it is assumed that the image forming system is configured by an apparatus 401 as reference, an apparatus that is positioned upstream (i.e., right in the figure) from the apparatus 401 ("upstream apparatus") 402, and an apparatus that is positioned downstream (left in the figure) of the apparatus 401 ("downstream apparatus") 403. Reference numeral 301 denotes a conveying path, which can convey sheets with rotation of conveyance rollers as illustrated in FIG. 3.

Figure 4A:
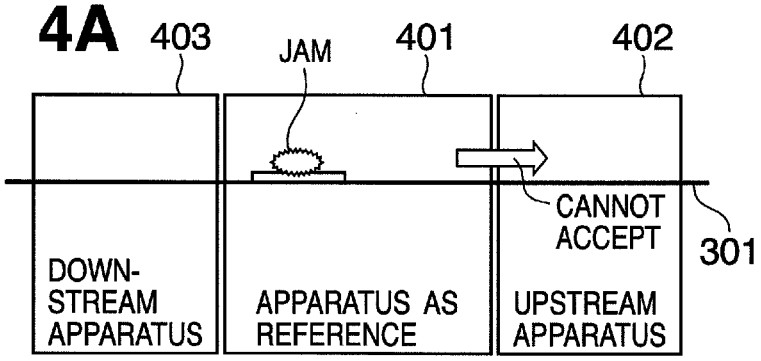
FIGS. 4A to 4D illustrate notification of whether an apparatus can accept sheets or not in the image forming system according to the embodiment.
Figure 4B:
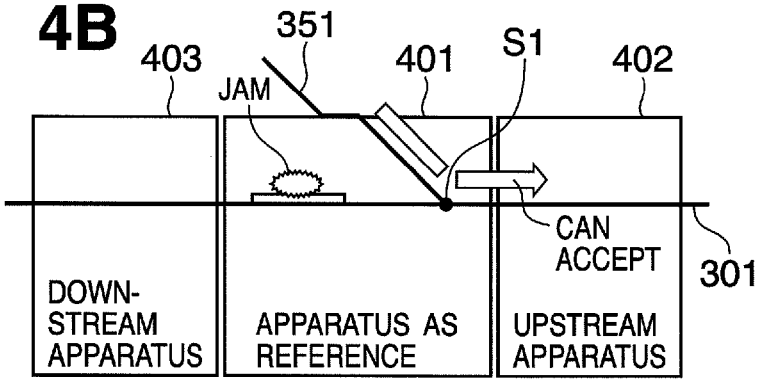

The example of FIG. 4A shows a state in which a paper jam is occurring on the apparatus 401. In this case, since there is no way to convey sheets other than the conveying path 301, in which the paper jam has occurred, the apparatus 401 cannot accept subsequent sheets. In this case, the apparatus 401 determines that it cannot accept sheets and notifies it to the upstream apparatus 402 based on the determination.

The example of FIG. 48 shows a state in which a paper jam is occurring on the apparatus 401, but a conveying path 351 (in this example, an escape path leading to an escape tray for urgently discharging sheets) is provided upstream from the jam position. Since it is possible to eject the sheets to the escape tray through the conveying path 351, the apparatus 401 can accept subsequent sheets from the upstream apparatus 402. In this case, the apparatus 401 determines that it can accept sheets and notifies it to the upstream apparatus 402 based on the determination.

Figure 4C:
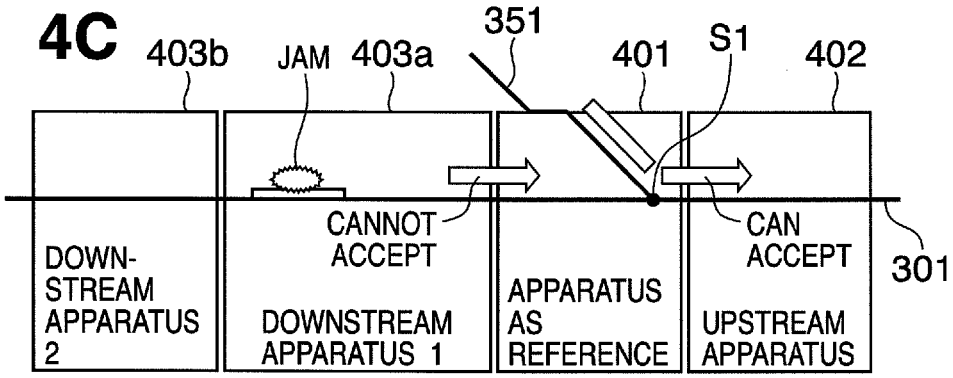

In the example of FIG. 4C, it is assumed that arranged apparatuses are the apparatus 401, and the upstream apparatus 402 that is positioned upstream of the apparatus 402, and a downstream apparatus 1 (403*a*) and a downstream apparatus 2 (403*b*) that are positioned downstream of the apparatus 401. The example of FIG. 4C shows a state in which a paper jam is occurring on the downstream apparatus 1 (403*a*). Since the downstream apparatus 1 (403*a*) is provided with no other path for conveying sheets than the conveying path 301, the downstream apparatus 1 (403*a*) cannot accept subsequent sheets from the apparatus 401. In this case, the downstream apparatus 1 (403*a*) determines that it cannot accept sheets and notifies it to the apparatus 401 based on the determination.

Upon receiving the notification of acceptance being impossible from the downstream apparatus 1 (403*a*), the apparatus 401 can no longer convey sheets to the downstream apparatus 1 (403*a*), but can accept sheets from the upstream apparatus 402 because there is the conveying path 351 (or escape path). In this case, the apparatus 401 determines that it can accept sheets and notifies it to the upstream apparatus 402 based on the determination.

Since a paper jam is occurring on the downstream apparatus 1 (403*a*), conveyance of sheets from the downstream apparatus 1 (403*a*) to the downstream apparatus 2 (403*b*) is stopped.

Figure 4D:
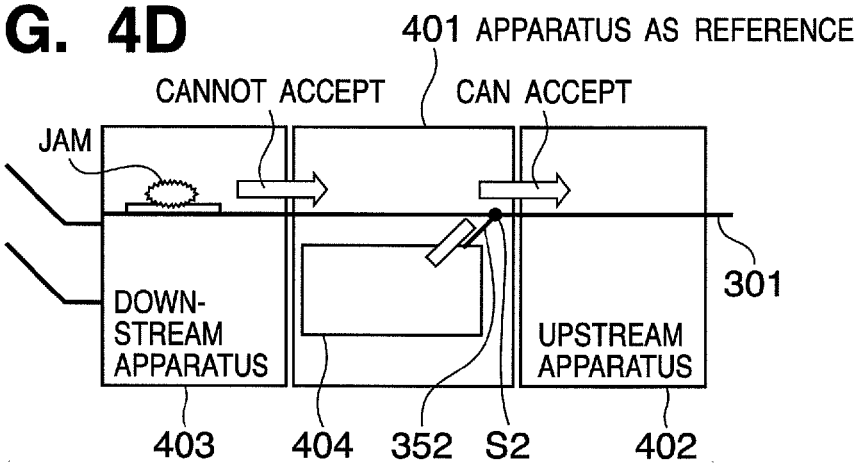

The example of FIG. 4D shows a state in which a paper jam is occurring on the downstream apparatus 403. Since the downstream apparatus 403 is provided with no other path for conveying sheets than the conveying path 301, the downstream apparatus 403 cannot accept following sheets from the apparatus 401. In this case, the downstream apparatus 403 determines that it cannot accept sheets, and notifies it to the apparatus 401 based on the determination. Upon receiving the notification of acceptance being impossible from the downstream apparatus 403, the apparatus 401 cannot continue to convey sheets to the downstream apparatus 403. However, the apparatus 401 can accept sheets from the upstream apparatus 402 because the apparatus 401 has the conveying path 352 for ejecting sheets (in this example, a stacker tray path leading to the stacker tray 404). In this case, the apparatus 401 determines that it can accept sheets and notifies it to the upstream apparatus 402 based on the determination. Even when preceding sheets get jammed on the downstream apparatus 403, the apparatus 401 discharges subsequent sheets (i.e., jobs)

onto the stacker tray 404 through the conveying path 352. Consequently, the apparatus 401 can continue to convey and discharge (or complete) subsequent sheets (i.e., subsequent jobs) successfully.

Processing performed on each apparatus during such sheet conveyance described above will be described with respect to flowcharts of FIGS. 5 and 6.

(Processing on an Apparatus on which a Paper Jam has Occurred)

Figure 5:
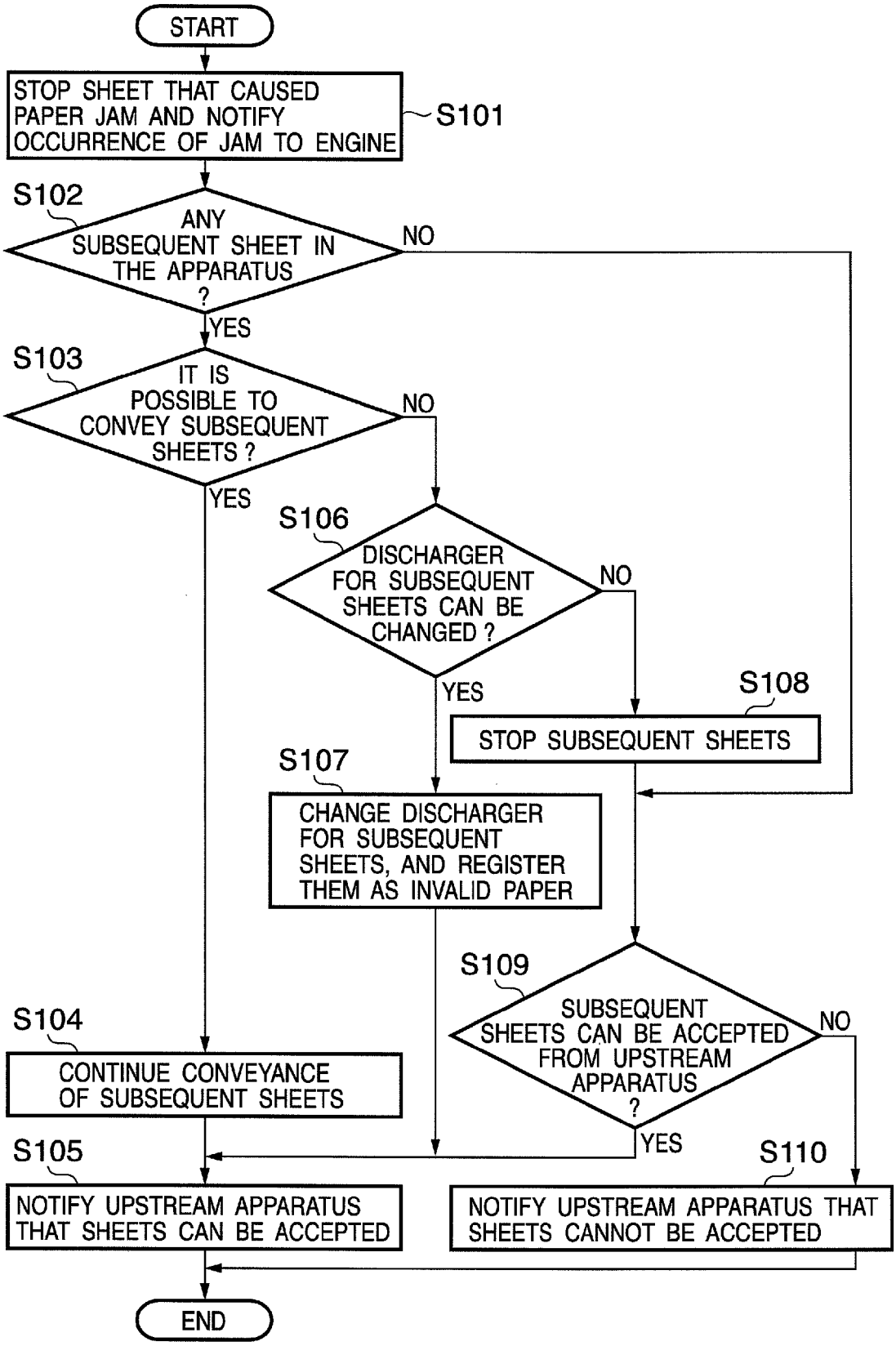
FIG. 5 is a flowchart showing processing on an apparatus on which a paper jam has occurred in an image forming system according to a first embodiment.

FIG. 5 is a flowchart showing processing done at an apparatus on which a paper jam has occurred. This processing is started when an abnormal condition (e.g., a paper jam) is detected by the conveying path sensors 304 and 305 under control of the CPU.

Initially, at step S101, conveyance of a sheet that caused the paper jam is stopped. If the paper jam has occurred on an apparatus other than the engine (ID1), the apparatus informs the engine that a paper jam has occurred on the apparatus. Upon being informed, the engine (ID1) can select subsequent processing, such as stopping additional sheet feeding in response to receiving a notification of paper jam occurrence, or continuing processing until the currently executed job ends.

Next, at step S102, it is determined whether there are subsequent sheets in the apparatus on which the paper jam has occurred. If there is additional sheets (YES at S102), processing proceeds to step S103, where it is determined whether it is possible to convey those sheets. The sheets may be conveyed when the conveying path on which the paper jam has occurred is different from a conveying path on which subsequent sheets are conveyed.

The apparatuses constituting the system can determine whether there is any conveying path for conveying recording media or any discharge tray based on detection of an abnormal condition by the detection unit (e.g., the conveying path sensor 304 or 305) under control of a CPU.

If it is determined at step S103 that the sheets can be conveyed (YES at S103), processing proceeds to step S104, where conveyance of subsequent sheets is continued in the apparatus on which the paper jam has occurred. This result of determination (YES at S103) indicates that subsequent sheets can be accepted, which has been described with FIGS. 4A to 4D.

At step S105, the apparatus on which the jam has occurred notifies the upstream apparatus that it can accept subsequent sheets based on the result of determination at step S103.

However, if subsequent sheets cannot be conveyed at step S103 (NO at S103), processing proceeds to step S106.

The apparatuses constituting the system are capable of changing available dischargers based on result of the determination under control of a CPU. A1

At step S106, the apparatus on which the paper jam has occurred determines whether or not it can change discharger of subsequent sheets remaining in the apparatus. Discharger may be changed when an escape tray onto which sheets are urgently discharged is attached or when another discharge tray is attached to the apparatus. In this case, it is required that there is no completed articles stacked on the tray (i.e., successfully discharged sheets) and that subsequent sheets are positioned upstream from the junction to a conveying path (e.g., S1 and S2 in FIGS. 4A to 4D) that leads to the discharger. If the conditions are satisfied, the conveying path used prior to occurrence of the paper jam (e.g., 301 of FIGS. 4A to 4D) is switched to another conveying path (e.g., 351 or 352 of FIGS. 4A to 4D) so that subsequent sheets are conveyed on the path.

If it is possible to change discharger of subsequent sheets (YES at S106), processing proceeds to step S107, where the discharger for subsequent sheets is changed and those sheets are registered as invalid paper. At the point the sheets registered as invalid paper are discharged to the new discharger, the apparatus now serving as the discharger informs the engine (ID1) of completion of discharge.

Determination result "YES" at step S106 indicates that subsequent sheets can be accepted, which was described with FIGS. 4A to 4D.

FIG. 12 illustrates a result of sheet discharge managed by the engine (ID1). When sheets have been successfully conveyed, those sheets are handled as sheets that have been successfully discharged ("normal sheets"). When sheets cannot be discharged normally due to occurrence of a paper jam, their discharger is changed and the sheets are handled as invalid paper.

In FIG. 12, job A is a job made up of four sheets and the discharger for the third and fourth sheets has been changed and they are registered as invalid paper. The figure shows that the first and second sheets constituting the job A were successfully discharged to the discharger originally specified. In this case, the first and second sheets are handled as normal sheets.

By referencing such information, the CPU 201 of the engine (ID1) can manage processing status of whether a started job has successfully gone through image formation and discharge.

The apparatus as the discharger informs the engine (ID1) that discharger is complete, and, upon being thus informed, the engine (ID1) checks whether involved sheets are registered as normal sheets or invalid paper (FIG. 12). If those sheets are normal sheets, the engine (ID1) outputs a discharge result notifying successful completion of discharge. If the sheets are invalid paper, however, the engine (ID1) outputs a discharge result notifying that discharge was not successfully done.

Next, at step S105, the apparatus on which the paper jam has occurred notifies the upstream apparatus that it can accept subsequent sheets based on determination result "YES" at step S106.

However, if the discharger for subsequent sheets remaining in the apparatus cannot be changed at step S106 (NO at S106), processing proceeds to step S10, where conveyance of subsequent sheets is stopped.

Next, at step S109, it is determined whether the apparatus can accept subsequent sheets from the upstream apparatus. Sheets can be accepted when an escape tray for urgently discharging sheets is attached to the apparatus or when a tray of another type is attached. For this case, it is required that there is no completed articles stacked on the tray (i.e., sheets that have been successfully discharged) and that stopped sheets that hinder conveyance of subsequent sheet are not present upstream from the junction to the conveying path leading to the discharger (S1 or S2 in FIGS. 4A to 4D).

If the apparatus can accept subsequent sheets at step S109 (YES at S109), processing proceeds to step S105. Here, the determination result "YES" at step S109 indicates that the apparatus can accept subsequent sheets, which was described with FIGS. 4A to 4D.

At step S105, the apparatus on which the jam has occurred informs the upstream apparatus that it can accept subsequent sheets based on determination result "YES" at step S109.

However, if the apparatus cannot accept subsequent sheets at step S109 (No at S109), processing proceeds to step S110. Here, determination result "No" at step S109 indicates that the apparatus cannot accept subsequent sheets, which was described with FIGS. 4A to 4D. At step S110, the apparatus on which the jam has occurred informs the upstream apparatus that it cannot accept subsequent sheets based on determination result "No" at step S109, and processing is terminated.

If there is no subsequent sheet in the apparatus on which the paper jam has occurred at step S102 (NO at S102), processing proceeds to step S109, where it is determined whether the apparatus can accept subsequent sheets from the upstream apparatus. Based on result of the determination, the apparatus on which the paper jam has occurred informs the upstream apparatus whether it can or cannot accept subsequent sheets (S105 and S110).

The apparatus on which the paper jam has occurred can determine whether it can convey subsequent sheets, whether it can change their discharger, and whether it can accept sheets from the upstream apparatus based on detection of an abnormal condition (i.e., a paper jam) and identification of functions provided by the apparatus, and notifies result of the determinations to the upstream apparatus.

(Processing Performed at an Apparatus that has Received Acceptance Advisability Information)

Figure 6:
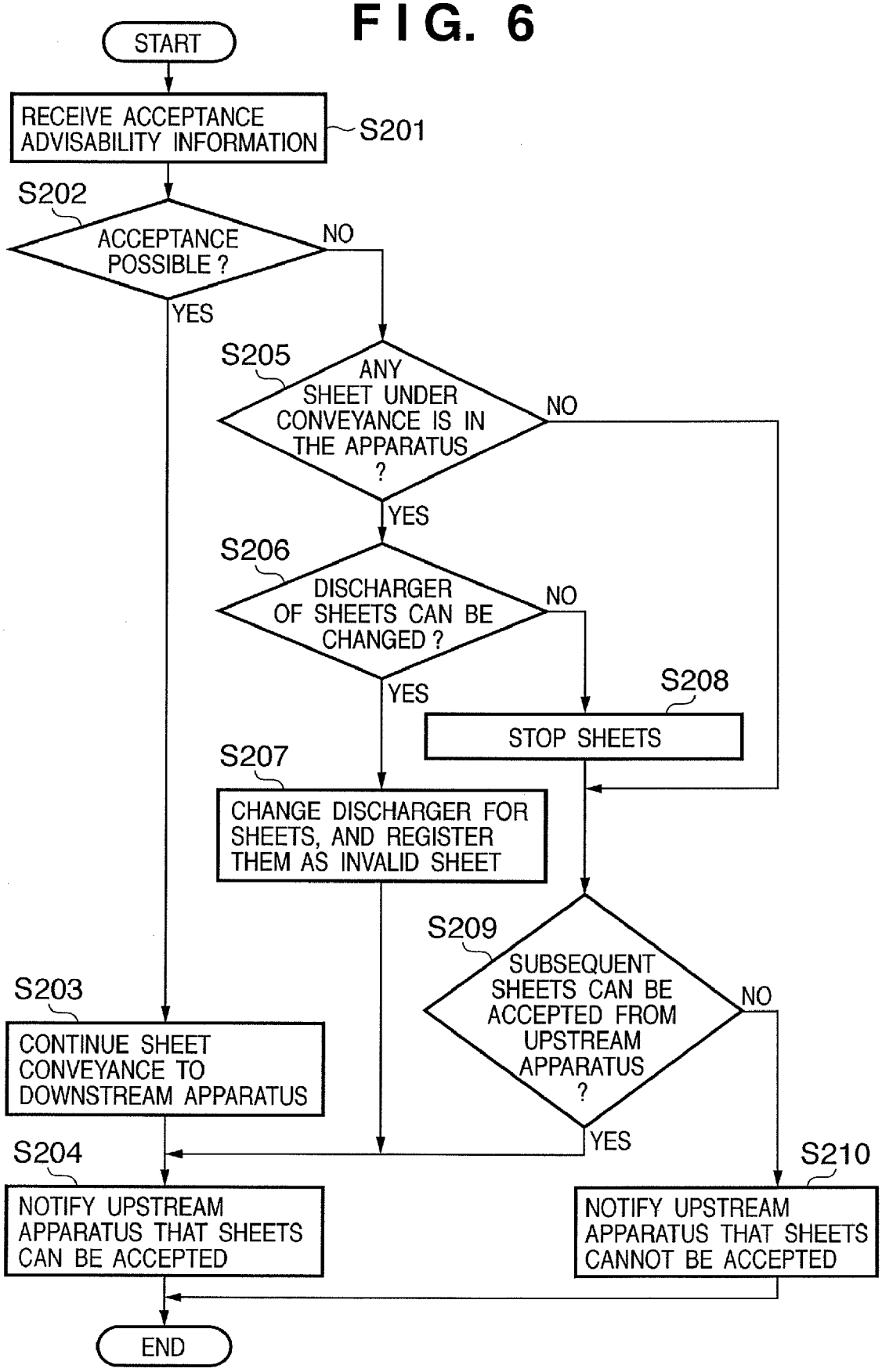
FIG. 6 is a flowchart showing processing on an apparatus that has received information on acceptance advisability in the image forming system according to the first embodiment.

FIG. 6 is a flowchart showing processing performed on an apparatus that has received acceptance advisability information. This processing starts when acceptance advisability information is received under control of a CPU.

First, at step S201, acceptance advisability information is received by the apparatus. At step S202, it is determined whether contents of the information indicates that acceptance is possible. If acceptance is possible (YES at S202), sheets continue to be conveyed (S203) because conveyance of sheets to the downstream apparatus can be continued.

Determination result "YES" at S202 indicates that subsequent sheets can be accepted, which was described with FIGS. 4A to 4D.

Next, at step S204, the apparatus informs the upstream apparatus that it can accept subsequent sheets.

However, if it is determined at step S202 that acceptance advisability information indicates that acceptance is impossible (NO at S202), processing proceeds to step S205, where it is determined whether there is any sheet under conveyance in the apparatus. If there are sheets under conveyance (YES at S205), processing proceeds to step S206, where it is determined whether it is possible to change the discharger for the sheets. The discharger for the sheets can be changed when an escape tray for urgently discharging sheets or a discharge tray of another type is attached to the apparatus. For this case, it is required that there is no completed articles stacked on the tray (i.e., sheets successfully discharged) and that subsequent sheets are present upstream from the junction to the conveying path leading to the discharger (e.g., S1 or S2 in FIGS. 4A to 4D). If these conditions are satisfied, the conveying path used prior to occurrence of the paper jam (e.g., 301 in FIGS. 4A to 4D) is switched to another conveying path (e.g., 351 or 352 in FIGS. 4A to 4D) so that subsequent sheets are conveyed on it.

If it is possible to change the discharger for the sheets under conveyance (YES at S206), processing proceeds to step S207, where the discharger for subsequent sheets is changed and those sheets are registered as invalid paper.

By referencing registration, the CPU 201 of the engine (ID1) can manage processing status of whether a started job has successfully gone through image formation and discharge.

Determination result "YES" at step S206 indicates that the apparatus can accept subsequent sheets, which was described with FIGS. 4A to 4D.

Next, at step S204, based on the determination result "YES" at step S206, the apparatus notifies the upstream apparatus that it can accept subsequent sheets.

However, if it is not possible to change the discharger for sheets in the apparatus at step S206 (No at S206), processing proceeds to step S208, where conveyance of sheets is stopped.

At step S209, it is determined whether the apparatus can accept subsequent sheets from the upstream apparatus. Sheets can be accepted when an escape tray into which sheets are urgently discharged or a discharge tray of another type is attached to the apparatus. In this case, it is required that there is no completed articles stacked on the tray (i.e., successfully discharged sheets) and that stopped sheets that hinders conveyance of subsequent sheets are not present upstream from the junction to the conveying path that leads to the discharger (S1 or S2 in FIGS. 4A to 4D).

If the apparatus can accept subsequent sheets at step S209 (YES at S209), processing proceeds to step S204. Here, determination result "YES" at step S209 indicates that the apparatus can accept subsequent sheets, which was described with FIGS. 4A to 4D.

At step S205, based on determination result "YES" at step S209, the apparatus informs the upstream apparatus that it can accept subsequent sheets.

However, if the apparatus cannot accept subsequent sheets at step S209 (NO at S209), processing proceeds to step S210. Here, determination result "No" at step S209 indicates that the apparatus cannot accept subsequent sheets, which was described with FIGS. 4A to 4D. At step S210, based on determination result "No" at step S109, the apparatus informs the upstream apparatus that it cannot accept subsequent sheets, and processing is terminated.

If there is no subsequent sheet in the apparatus at step S205 (NO at S202), processing proceeds to step S209, where it is determined whether the apparatus can accept subsequent sheets from the upstream apparatus. Based on the result of the determination, the apparatus informs the upstream apparatus whether it can or cannot accept subsequent sheets (S204, S210).

The apparatus informed of acceptance advisability information can determine whether it can convey subsequent sheets, change their discharger, and accept sheets from the upstream apparatus based on determination of contents of the acceptance advisability information and identification of its own functions, and inform the result of the determination to its upstream apparatus.

If a failure occurs on an apparatus that constitutes an image forming system, the apparatus notifies its upstream apparatus whether it can or cannot accept sheets. Based on the contents of the notification and its own functions, the upstream apparatus determines whether it can convey subsequent sheets, change their discharger, and accept sheets from its upstream apparatus.

According to the present system, it is possible to control whether to continue sheet conveyance, change sheets' discharger, and accept sheets in accordance with condition of an apparatus in question or an apparatus downstream from it without one having to being conscious about the arrangement of apparatuses constituting the entire image forming system.

Also, according to the present system, information for managing the configuration of the entire image forming system is no longer necessary with respect to conveyance and discharge of sheets, so that control of the entire system can be simplified.

Since it is possible to control whether to continue sheet conveyance, change their discharger, and accept sheets in accordance with condition of an apparatus in question or an apparatus downstream from it, change of apparatuses arrangement can be flexibly addressed and usability can be improved in terms of system construction.

Or, according to the present system, invalid paper can be reduced by continuing system operation when a job currently executed can be continued (i.e., when the job can result in completed articles) even if a failure occurs on an apparatus constituting the system.

According to the present system, when sheet conveyance is stopped due to occurrence of an abnormal condition, it is possible to minimize sheets that would remain in the image forming system by discharging them to an escape tray.

Second Embodiment

The following will describe an embodiment in which information indicating whether an apparatus can accept sheets or not is notified when a failure occurs during conveyance of sheets or other processes as the second embodiment of the invention.

As the configuration and connection form of the image forming system are the same as the first embodiment, description of them will be omitted. Only points at which different processing is performed will be described with respect to FIGS. 7 to 11.

Figure 7:
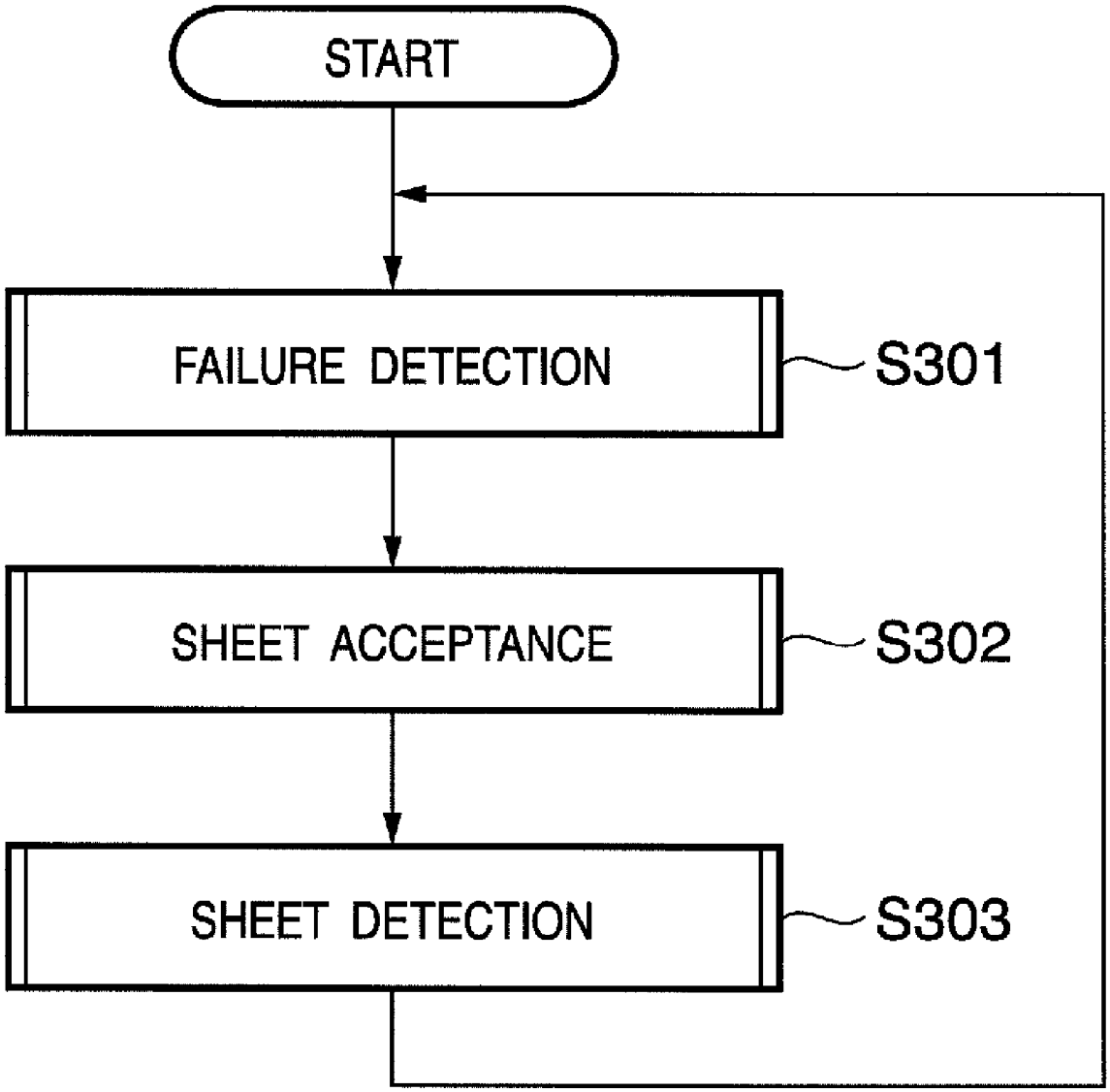
FIG. 7 is a flowchart showing processing that is always executed by apparatuses constituting an image forming system according to a second embodiment.

FIG. 7 is a flowchart showing processing that is continuously executed by apparatuses constituting the image forming system of the second embodiment, which starts when the system is powered on.

First, at step S301, detection of a failure in portions relating to sheet conveyance in an apparatus is performed. If a failure has occurred on the apparatus or if it receives acceptance advisability information from the downstream apparatus, the apparatus sends information on whether it can accept sheets or not to the upstream apparatus according to its condition. Details of this processing will be described with FIG. 8.

At step S302, processing for accepting sheets from the upstream apparatus is performed. This processing is communication of sheet conveyance commands with the upstream apparatus based on condition of the apparatus in question, which will be described in detail with FIG. 9.

At step S303, processing for conveying sheets to the discharge tray of the apparatus or to the downstream apparatus is performed. This processing is communication of sheet conveyance commands with the downstream apparatus based on condition of the apparatus in question or the downstream apparatus, which will be described in detail in FIG. 10.

(Failure Detection Processing: S301 in FIG. 7)

Figure 8:
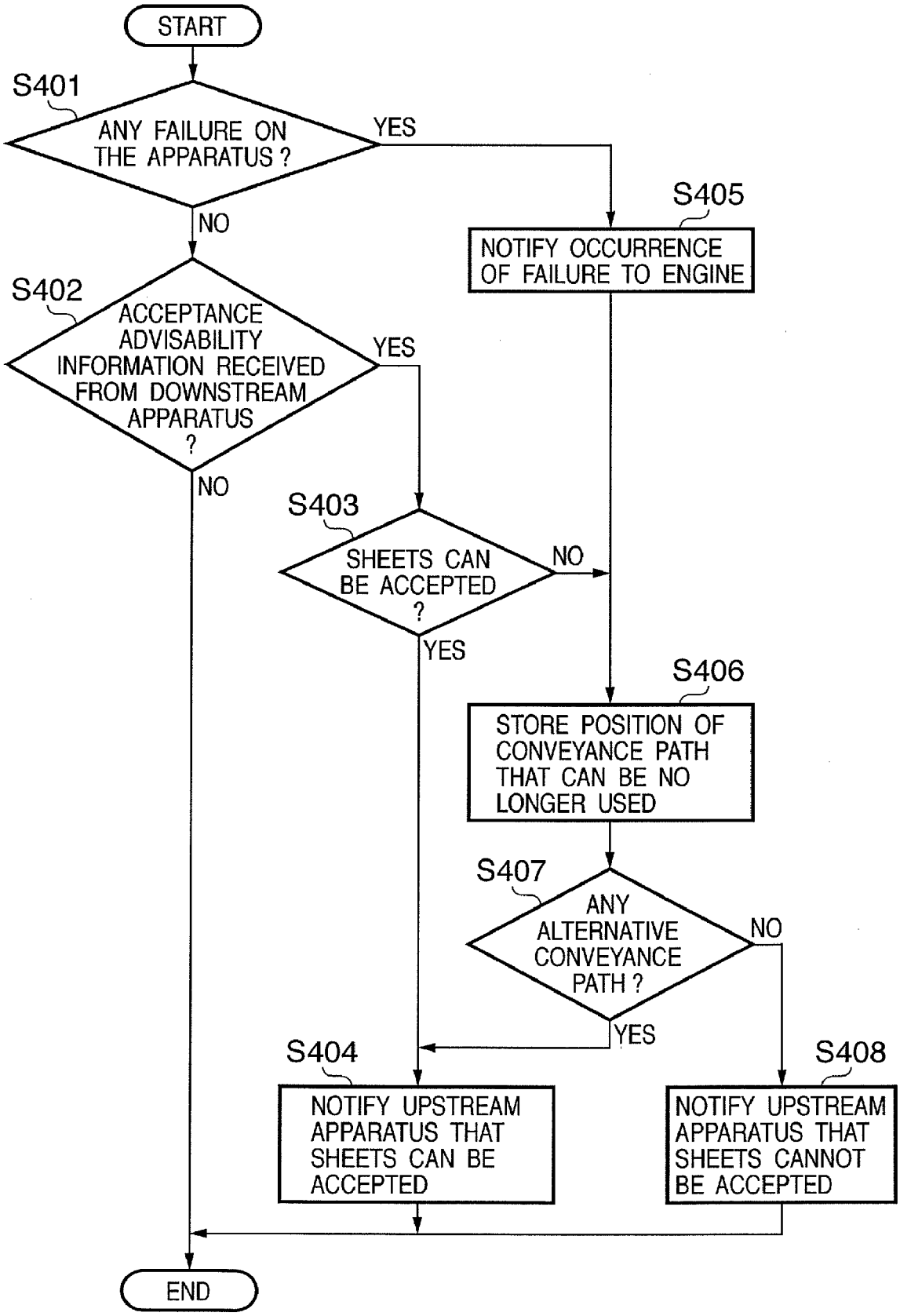
FIG. 8 is a flowchart showing failure detection processing on an apparatus that corresponds to step S301 of FIG. 7.

Failure detection processing on an apparatus will be described with FIG. 8. FIG. 8 is a flowchart showing processing for detecting a failure on an apparatus that corresponds to step S301 of FIG. 7. This processing is executed under control of a CPU.

First, at step S401, it is determined whether a failure has occurred on an apparatus. Here, a "failure" means a state in which sheets cannot be conveyed, such as when a paper jam has occurred during sheet conveyance, when the door of the apparatus is opened, or when the apparatus determines that a motor for driving conveyance rollers is out of order from self-diagnosis.

If a failure occurring on the apparatus at step S401 (YES at S401), processing proceeds to step S405, where the apparatus informs the engine (ID1) of occurrence of the failure unless the apparatus is the engine. And processing proceeds to step S406.

If no failure is occurring on the apparatus at step S401 (NO at S401), however, processing proceeds to step S402.

At step S402, the apparatus determines whether it has received sheet acceptance advisability information from the downstream apparatus. If it has not received sheet acceptance advisability information (NO at S402), processing is terminated because the apparatus has no trouble.

However, if it has received acceptance advisability information from the downstream apparatus at step S402 (YES at S402), processing proceeds to step S403, where it is determined whether the information indicates whether the downstream apparatus can accept sheets or not. If the downstream apparatus can accept sheets (YES at S403), the apparatus notifies the upstream apparatus that it can accept sheets (S404).

If the sheet acceptance advisability information indicates that the downstream apparatus cannot accept sheets at step S403 (NO at S403), processing proceeds to step S406.

At step S406, the apparatus in question identifies any conveying path that can be no longer used due to the failure occurring on the apparatus or based on notification of acceptance impossible sent from the downstream apparatus, and stores the path in RAM (such as 205 and 2203).

Figure 11:
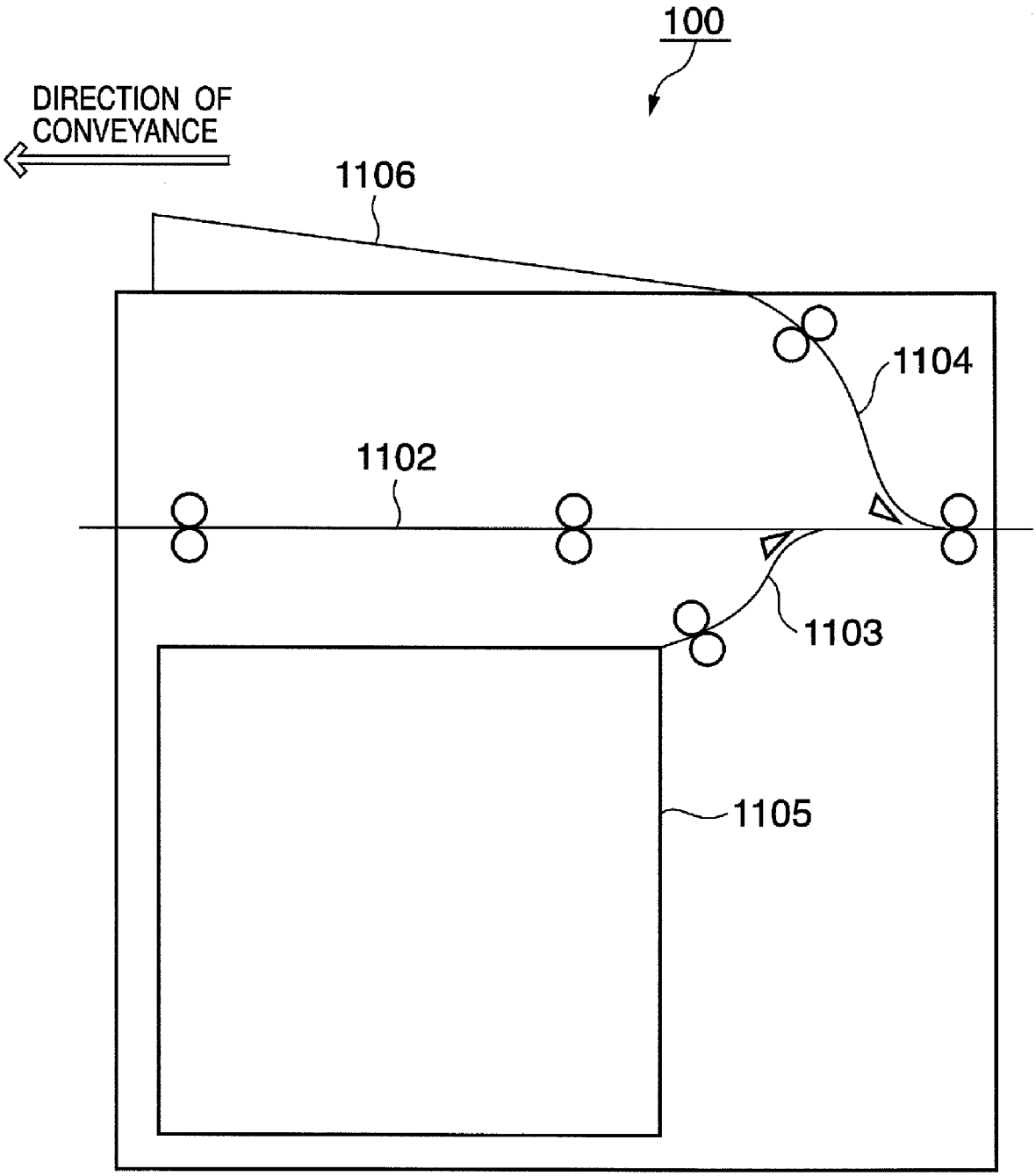
FIG. 11 illustrates a case where a conveying path for apparatuses constituting the image forming system according to an embodiment of the invention is unusable.

For example, a paper jam occurs while sheets are discharged to the stacker tray 1105 in the configuration of the image forming apparatus shown in FIG. 11, the CPU 201 determines that the conveying path 1103 is unavailable and stores the result of the determination to the RAM 205. When it receives notification that the downstream apparatus cannot accept sheets from the downstream apparatus, the CPU 201 of the image forming apparatus determines that the conveying path 1102 is unavailable and stores the determination result to the RAM 205.

Returning to FIG. 8, at step S407, the apparatus in question determines whether there is any conveying path that can be used alternatively. For example, in the case of FIG. 11, the conveying path 1104 leading to the escape tray 1106 is available even if the conveying paths 1102 and 1103 can be no longer used, so there is an alternative conveying path in this case.

The apparatuses constituting the system are capable of changing available conveying paths based on information on unavailable conveying paths stored in the RAM 205 under control of CPUs.

If there is an alternative conveying path at step S407 (YES at S407), processing proceeds to step S404, where the apparatus in question notifies the upstream apparatus that it can accept sheets (S404).

However, if there is no alternative conveying path at step S407 (NO at S407), processing proceeds to step S408, where the apparatus in question notifies the upstream apparatus that it cannot accept sheets (S408), and processing is terminated.

With the processing, when an apparatus detects a failure occurring on the apparatus or from notification of acceptance impossible sent from the downstream apparatus, the apparatus can notifies its upstream apparatus whether it can accept sheets or not according to its condition.

(Sheet Acceptance Processing: S302 of FIG. 7)

Figure 9:
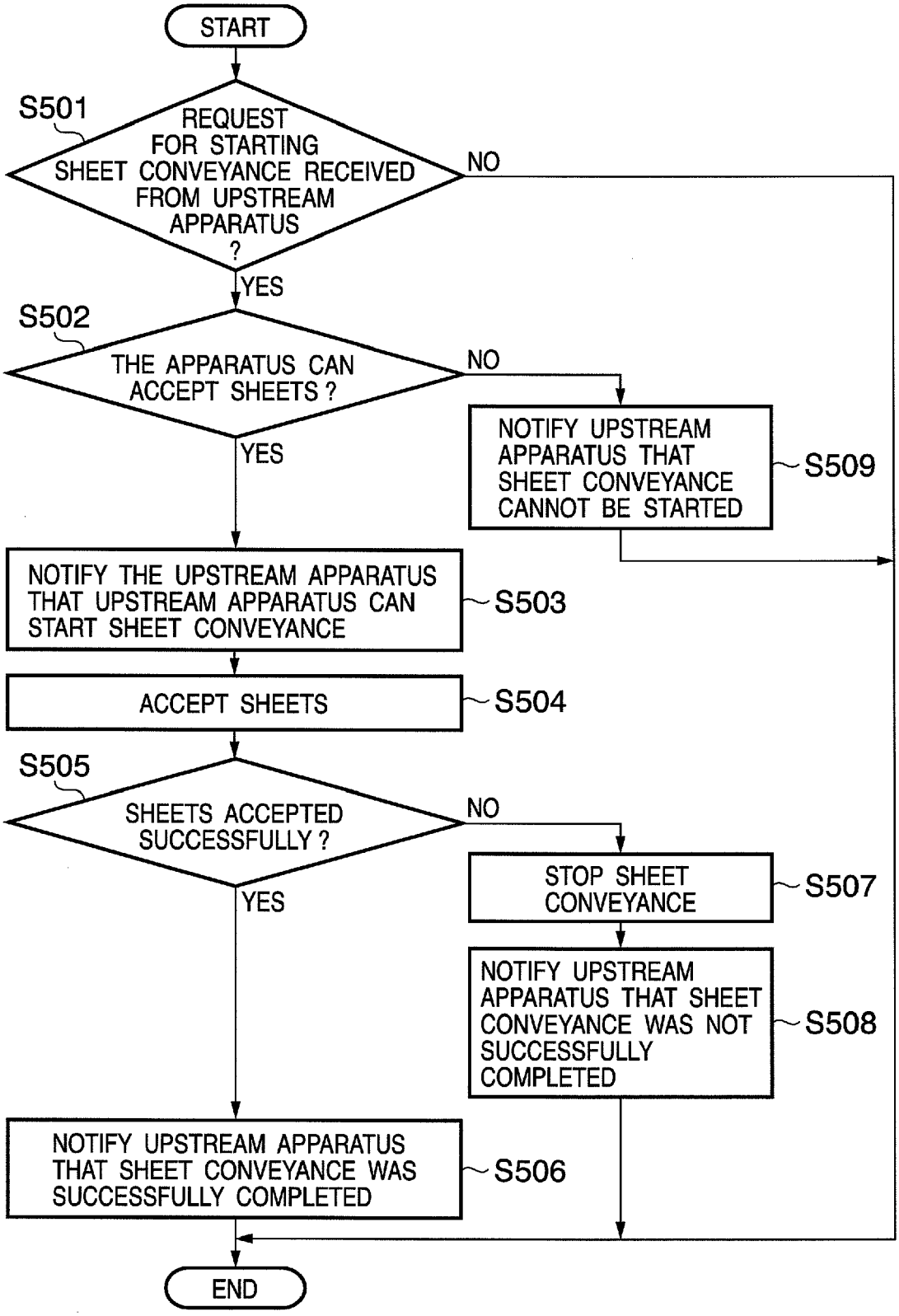
FIG. 9 is a flowchart showing sheet acceptance processing on an apparatus that corresponds to step S302 of FIG. 7.

Sheet acceptance processing on an apparatus will be described with FIG. 9. Here, FIG. 9 is a flowchart showing processing for sheet acceptance on an apparatus that corresponds to step S302 of FIG. 7. This processing is executed under control of a CPU.

At step S501, an apparatus determines whether it has received a request for starting sheet conveyance from the upstream apparatus.

If it has not received a request for starting sheet conveyance at determination in step S501 (NO at S501), processing is terminated. If the apparatus has received a request for starting sheet conveyance (YES at S501), however, processing proceeds to step S502.

At step S502, the apparatus determines whether it can accept sheets or not. If it can accept sheets (YES at S502), processing proceeds to step S503, where the apparatus notifies the upstream apparatus that the upstream apparatus may start sheet conveyance.

Sheet acceptance operation is executed at step S504, and, at step S505, it is determined whether the operation has been successfully completed.

If it is determined at step S505 that the sheet accepting operation has been successfully completed (YES at S505), processing proceeds to step S506, where the apparatus notifies the upstream apparatus that that sheet conveyance has been successfully completed.

However, if sheet accepting operation has not been successfully completed at step S505 (No at S505), processing proceeds to step S507, sheet conveyance is stopped at step S507, and the apparatus notifies the upstream apparatus that sheet conveyance did not successfully completed at step S508.

If it is determined at step S502 that the apparatus in question cannot accept sheets (No at S502), processing proceeds to step S509, where the apparatus informs the upstream apparatus that the upstream apparatus cannot start sheet conveyance, and processing is terminated.

With the processing, when an apparatus accepts sheets conveyed from the upstream apparatus, the apparatus can execute sheet accepting operation in accordance with its condition and notify the upstream apparatus whether the operation has successfully completed or not.

(Sheet Discharge Processing: S303 of FIG. 7)

Figure 10:
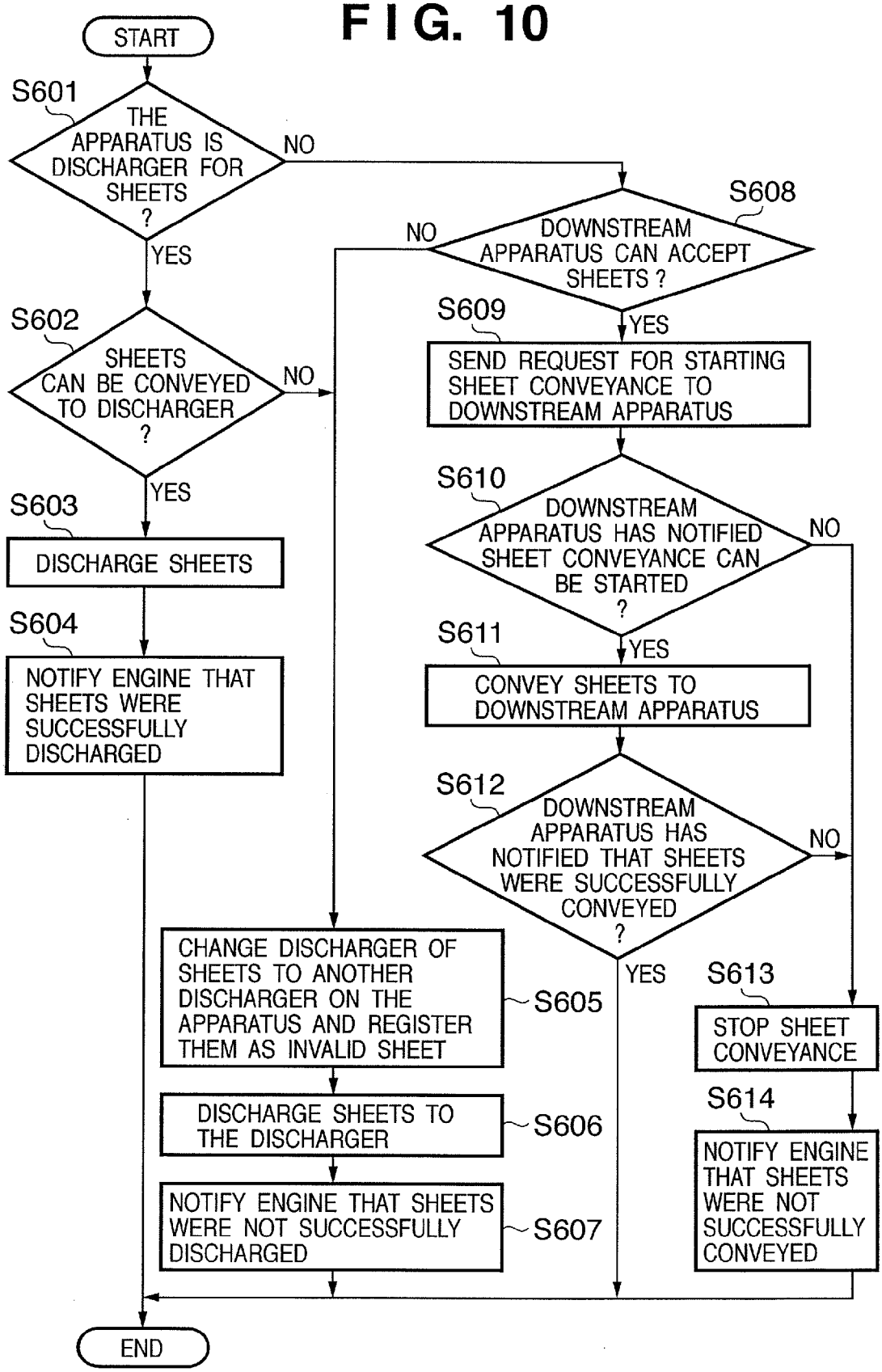
FIG. 10 is a flowchart showing sheet discharge processing on an apparatus that corresponds to step S303 of FIG. 7.

Sheet discharge processing on an apparatus will be described with FIG. 10. FIG. 10 is a flowchart showing sheet discharge processing on an apparatus that corresponds to step S303 of FIG. 7. This processing is executed under control of a CPU.

At step S601, an apparatus determines whether the discharger for sheets is the apparatus or not. If it is determined at step S601 that the apparatus is the discharger of sheets (YES at S601), processing proceeds to step S602, where the apparatus determines whether it can convey sheets to the discharger (S602). This determination is made based on information on an unavailable conveying path (S406 of FIG. 8) that is stored during failure detection processing at S301 of FIG. 7.

If it is determined at step S602 that sheets can be conveyed (YES at S602), processing proceeds to step S603.

After the apparatus discharges sheets at step S603, the apparatus notifies the engine (ID1) at step S604 that sheets have been successfully discharged.

By referencing the notification of successful sheet discharge, the CPU 201 of the engine (ID1) can confirm that a started job has successfully gone through image formation and discharge.

However, if the apparatus in question determines that it cannot convey sheets to the discharger at step S602 (NO at S602), processing proceeds to step S605, where the discharger for sheets is changed to another discharger on the apparatus (S605).

In addition, sheets that have been redirected to another discharger at step S605 are registered as invalid paper.

Next, at step S606, the apparatus discharges sheets to the discharger changed at step S605 and processing proceeds to step S607.

Since sheets could not be discharged to the originally intended discharger, the apparatus notifies the engine (ID1) that sheets were not successfully discharged at step S607.

The notification of unsuccessful sheet discharge can also include information on sheets that are registered as invalid paper at step S605. By referencing information on sheets registered as invalid paper, the CPU 201 of the engine (ID1) can manage processing status of whether a started job has successfully gone through image formation and discharge.

If the apparatus is not the discharger at step S601 (NO at S601), processing proceeds to S608, where the apparatus determines whether the downstream apparatus can accept sheets or not. This determination is made in failure detection processing (S301 in FIG. 3 and S406 in FIG. 8) based on stored information about conveying paths stored as unavailable paths. For example, in FIG. 11, when the conveying path 1102 for conveying sheets to the downstream apparatus is unavailable, the CPU of the apparatus determines that the downstream apparatus cannot accept sheets.

If it is determined at step S608 that the downstream apparatus cannot accept sheets (No at S608), the apparatus cannot continue to convey sheets to the downstream apparatus and thus has to discharge sheets on the apparatus itself. In this case, processing proceeds to step S605, where the discharger for sheets is changed to another discharger on the apparatus (S605).

If it is determined at step S608 that the downstream apparatus can accept sheets (YES at S608), processing proceeds to step S609, where the apparatus sends a request for starting sheet conveyance to the downstream apparatus (S609). Upon receiving the request for starting sheet conveyance, the downstream apparatus executes sheet acceptance processing in accordance with the flowchart described with FIG. 9.

If the apparatus notified by the downstream apparatus that the apparatus can start sheet conveyance (S503 of FIG. 9) at step S610 (YES at S610), processing proceeds to step S611, where the apparatus conveys sheets to the downstream apparatus (S611).

At step 612, the apparatus stands by in a state in which it waits for reception of a notification indicating successful completion of sheet conveyance (S506 of FIG. 9) that is sent from the downstream apparatus. When the apparatus receives a notification indicating successful completion of sheet conveyance (YES at S612), sheet conveyance processing on the apparatus terminates.

If the apparatus does not receive a notification indicating successful completion of sheet conveyance at step S612 (No at S612), processing proceeds to step S613. The apparatus determines that sheets were not successfully conveyed and discharged on the downstream apparatus and stops conveying sheets (S613).

At step S614, the apparatus notifies the engine (ID1) that sheets were not successfully conveyed (i.e., sheets cannot be conveyed), and processing is terminated.

By referencing notification of unsuccessful sheet conveyance, the CPU 201 of the engine (ID1) can control start of subsequent sheets (i.e., jobs) to prevent sheets from remaining within the image forming system.

If the apparatus could not receive a notification indicating that the apparatus can start sheet conveyance from the downstream apparatus at step S610 (NO at S610), processing proceeds to step S613, where the apparatus stops discharge of sheets. This situation occurs when a failure has occurred on the downstream apparatus but the apparatus has not received sheet acceptance advisability information from the downstream apparatus yet, or when a communication error occurs with the downstream apparatus. When the downstream apparatus cannot accept sheets, the downstream apparatus informs the upstream apparatus that the upstream apparatus cannot start sheet conveyance (S509 at FIG. 9).

With the processing, when an apparatus discharges sheets to a discharger provided on the apparatus or when an apparatus discharges sheets to the downstream apparatus, sheet conveyance processing can be made in accordance with condition of the apparatus in question or the apparatus downstream from it.

Information for managing the arrangement of the entire image forming system is no longer required with respect to conveyance and discharge of sheets, which can simplify control of the entire system.

Since it is possible to control whether to continue sheet conveyance, change sheet discharger, and accept sheets in accordance with condition of an apparatus in question or the apparatus downstream from it, change of apparatus arrangement can be flexibly addressed and usability can be enhanced in terms of system construction.

Also, according to the present system, invalid paper can be reduced by continuing system operation when a job currently executed can be continued (i.e., when the job can result in completed articles) even if a failure occurs on an apparatus constituting the system.

By selecting an available conveying path, redirecting subsequent sheets (i.e., jobs) to a different discharger and continuing sheet discharge, sheets that would remain in the system can be minimized.

Other Embodiments

It goes without saying that the object of the present invention may also be accomplished by supplying a system or an apparatus with a storage medium storing thereon a program code of software which realizes the functions of the above described embodiment. The object of the invention may also be accomplished by a computer (or CPU or MPU) of the system or apparatus reading out the program code stored in the storage medium and executing the same.

In this case, the program code itself read out from the storage medium realizes the functions of the above described embodiment and hence the storage medium storing the program code constitutes the present invention.

The storage medium for supplying the program code may be a flexible disk, hard disk, optical disk, magneto-optical disk, CD-ROM, CD-R, non-volatile memory card and ROM.

Through execution of the program code read out by the computer, the functions of the above described embodiment are realized. A case is also encompassed where an operating system (OS) running on the computer executes some or all of actual processing in accordance with instructions of the program code so as to realize the above described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-258309, filed Sep. 6, 2005 which is hereby incorporated by reference herein in its entirety.

What is claimed is:

1. An image forming system that having a plurality of sheet processing apparatuses arranged serially for processing recording media and conveying the recording media from the sheet processing apparatus positioned upstream of the recording media conveying direction to the sheet processing apparatus positioned downstream thereof, each of the sheet processing apparatuses comprising:

a detection unit adapted to detect an abnormal condition occurring in the respective sheet processing apparatus;

a reception unit adapted to receive, in a case where an abnormal state is detected by a detecting unit of any one of the plurality of sheet processing apparatuses, acceptance advisability information sent from the sheet processing apparatus positioned immediately downstream of the respective sheet processing apparatus for determining whether the recording media are acceptable or not by the immediately downstream sheet processing apparatus;

a determination unit adapted to determine whether the recording media to be conveyed from the sheet processing apparatus positioned immediately upstream of the respective sheet processing apparatus are acceptable or not based on a configuration of an escape conveying path, which is available in the respective sheet processing apparatus, and the acceptance advisability information received by the reception unit of the respective sheet processing apparatus; and a notification unit adapted to send determination result by the determination unit to the sheet processing apparatus positioned immediately upstream of the respective sheet processing apparatus as acceptance advisability information for the respective sheet processing apparatus.

2. The image forming system according to claim 1, wherein:

in a case where the abnormal state is not occurred in the sheet processing apparatus positioned immediately upstream of the respective sheet processing apparatus, the determination unit of the sheet processing apparatus having the conveying path for escaping determines that the recording media are acceptable, and the notification unit of the sheet processing apparatus having the escaping conveying path sends the acceptance advisability information indicating that the recording media are acceptable to the immediate upstream sheet processing apparatus.

3. The image forming system according to claim 2, wherein;

in a case where the reception unit receives the acceptance advisability information indicating that the recording media are not acceptable, the determination unit of the sheet processing apparatus with which the escape conveying path is not provided determines that the recording media are not acceptable; and the notification unit of the sheet processing apparatus with which the escape conveying path is not provided sends the acceptance advisability information indicating that the recording media are not acceptable by the immediate upstream sheet processing apparatus.

4. The image forming system according to claim 1, further comprising a conveyance start requirement reception unit adapted to receive a conveyance start requirement for the recording media from the immediate upstream sheet processing apparatus, wherein, in response to reception of the conveyance start requirement, the determination unit determines whether the recording media are acceptable or not based on the detection unit detecting an abnormal condition or the acceptance advisability information sent from the immediate downstream sheet processing apparatus, and the notification unit sends the result of the determination unit to the immediate upstream sheet processing apparatus.

5. The image forming system according to claim 4, wherein, conveyance of the recording media to the immediate downstream sheet processing apparatus is controlled based on information indicating whether the immediate downstream sheet processing apparatus accepts the recording media or not that is sent from the immediate downstream sheet processing apparatus in response to a conveyance start requirement for the recording media sent to the immediate downstream sheet processing apparatus and received by the reception unit of the respective sheet processing apparatus.

* * * * *